US005259126A

United States Patent [19]

Rosen

[11] Patent Number: 5,259,126

[45] Date of Patent: Nov. 9, 1993

[54] SHOE CONSTRUCTION HAVING IMPROVED BACKPART FIT

[76] Inventor: Henri E. Rosen, 229 Coolidge Ave., Watertown, Mass. 02172

[21] Appl. No.: 837,758

[22] Filed: Feb. 19, 1992

Related U.S. Application Data

[63] Continuation-in-part of Ser. No. 614,862, Nov. 16, 1990, abandoned, which is a continuation-in-part of Ser. No. 389,252, Aug. 2, 1989, abandoned.

[51] Int. Cl.[5] ..... A43B 3/26

[52] U.S. Cl. ..... 36/93; 36/97; 36/55

[58] Field of Search ..... 36/97, 93, 112, 10, 36/94, 95, 96, 11.5, 7.1 R, 55, 58.5

[56] References Cited

U.S. PATENT DOCUMENTS

| | | | |
|---|---|---|---|
| 1,282,584 | 10/1918 | Hunter | 36/585 |
| 2,440,563 | 4/1948 | Woyach | 36/7.3 |
| 2,771,691 | 11/1956 | Luchs | 36/10 |
| 2,776,500 | 1/1957 | Gonsalves | 36/10 |
| 3,095,656 | 7/1963 | Lipare | 36/97 |
| 3,289,329 | 12/1966 | Weiss | 36/10 |
| 3,315,276 | 4/1967 | Daxe | 36/10 |
| 3,431,658 | 3/1969 | Finn | 36/58.5 |
| 4,169,324 | 10/1979 | Gibbs | 36/83 |
| 4,575,954 | 3/1986 | Bye | 36/89 |

FOREIGN PATENT DOCUMENTS

| | | | |
|---|---|---|---|
| 0109384 | 5/1984 | European Pat. Off. | 36/55 |
| 172246 | 4/1905 | Fed. Rep. of Germany | 36/58.5 |

*Primary Examiner*—Steven N. Meyers
*Assistant Examiner*—Ted Kavanaugh
*Attorney, Agent, or Firm*—Bruce F. Jacobs

[57] ABSTRACT

A device which functions to improve the fit of shoes is described whereby the shoe is urged forward on the foot by means of an elastic member to minimize slippage of the backpart of the shoe relative to the heel of the wearer's foot.

6 Claims, 2 Drawing Sheets

SHOE CONSTRUCTION HAVING IMPROVED BACKPART FIT

CROSS REFERENCE TO RELATED APPLICATION

This application is a continuation-in-part of U.S. Ser. No. 07/614,862, filed Nov. 16, 1990 now abandoned, which is a continuation-in-part of U.S. Ser. No. 07/389,252, filed Aug. 2, 1989, now abandoned.

BACKGROUND OF THE INVENTION

Many of today's footwear products do not continually afford proper backpart fit of the shoe relative to the heel of the wearer's foot. This is particularly true for low-cut shoes having relatively long topline openings and inadequate means of adjusting the dimensions of those openings or the inside girth of the shoes. Examples of such conventional shoe styles include women's high heels pumps and flat or 'skimmer' styles as well as casual slip-on designs such as loafers, espadrilles, and the like.

The problem of improper backpart fit stems from the tendency of shoes to stretch with wear, thereby allowing the foot to move forward in the shoe to such an extent that the heel loses contact with the back part of the shoe, resulting in looseness and slippage during use.

To date, the attempts to minimize this problem, which have been less than completely successful, have included back straps with elastic elements therein, counter and other insertable spacers or shims to tighten the fit, as well as the widely accepted but improper practice of fitting and selling shoes that are too snug girthwise and/or widthwise for the feet on which they are to be worn. Such fitting techniques often lead to serious consequences including foot discomfort and eventual health problems.

It is an object of the present invention to provide improved means to continually and gently urge a shoe continually forwards on the foot so that the backpart of the shoe will tend to stay in contact with the heel of the foot throughout the stride cycle and throughout the useful life of the shoe.

U.S. Pat. No. 4,575,954 (Bye) discloses a stretchable sock disposed within a shoe cavity. The purpose of the sock to provide additional support to the ankle of a foot inserted therein to inhibit lateral inward rolling of the ankle without unduly restricting foot flexion about the ankle joint in fore and aft directions. In addition, the sock is attached to the inside of the shoe to inhibit motion between the foot and shoe. Substantially constant pressure is, however, not exerted against the toes of the foot (other than would exist in any conventional sock) This is made clear in the specification at column 3, lines 3-4 wherein it is stated that stocking or sock is virtually non-elastic in the lengthwise direction. Rather, the Bye shoe system achieves stability by a totally different mechanism; the attachment of the sock to the interior of the shoe. Such a cumbersome sock system would not be suitable for use in a conventional shoe such as a woman's dress shoe, since it would extend out of the shoe to cover the ankle. This would result in an aesthetically displeasing shoe.

U.S. Pat. No. 2,440,563 (Woyach) discloses a removable protective lining for a storm boot. It contains no means for exerting a substantially constant pressure against the toes of a foot and nothing to urge a shoe forward on a foot to prevent heel slippage.

German Offen. 2,259,206 (Benner) discloses an insert for a child's ski-boot to change the length of the boot so that a too large boot may be used for a number of seasons. The insert has a dense outer surface to function as the normal relatively firm toe of a shoe. When a child's foot has grown to such an extent that the toes reach the insert, the insert is intended to be removed so that no substantially constant pressure is ever exerted against the toes. Accordingly, the insert can not continually urge a shoe forward on a foot.

SUMMARY OF THE INVENTION

Many popular shoe styles experience problems with the fit of the backpart of the shoe against the wearer's foot. This is particularly the case with styles having relatively long topline openings and a relatively short enclosed forepart, with little or no means of topline length or shoe girth adjustment, as in women's high heels, pumps, skimmers, flats, and many other conventional slip-on styles including loafers, espadrilles, and the like. As defined herein the term "shoe" means a shoe having a relatively long topline opening and a relatively short enclosed forepart such as those described above.

The present invention is directed to a substantially concealed elastic means which exerts substantially constant pressure on the toes of a foot in a shoe so as to continually urge the shoe gently forward on a foot As a result, the backpart of the shoe remains in comfortable and substantially constant contact with the heel of the wearer's foot. Preferably, the elastic member is an elastically stretchable member such as an elastically stretchable lining element disposed in the shoe cavity. The elastic means may either be permanently attached and an integral part of the shoe.

For a fuller understanding of the nature and objects of the present invention, reference will be made to the following detailed description taken in connection with the accompanying drawings.

DESCRIPTION OF THE PREFERRED EMBODIMENTS

Figure 1:
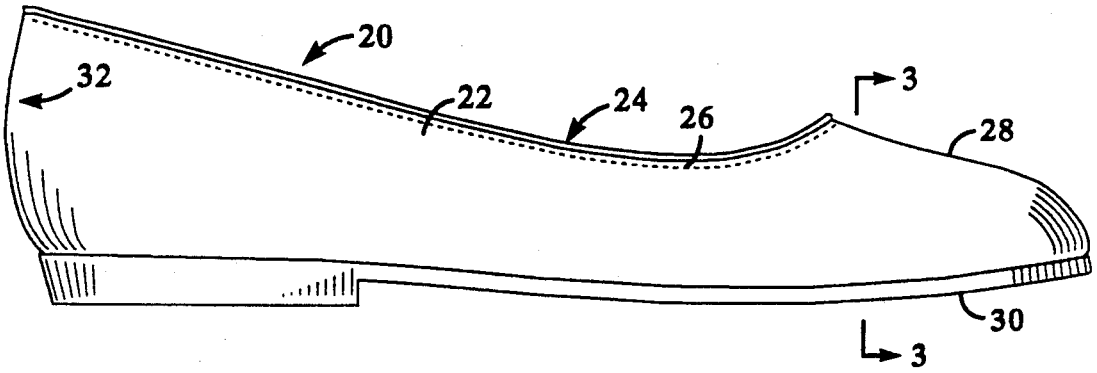
FIG. 1 is a side elevational view of a typical shoe within which principles of the present invention may be employed.
Figure 2:
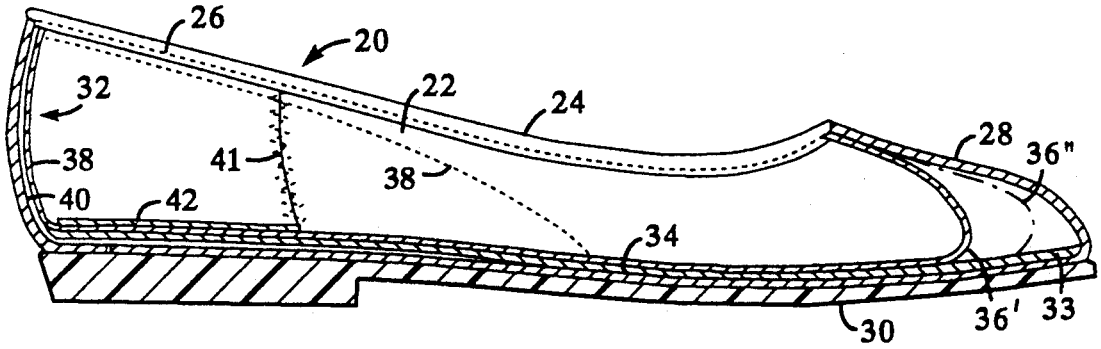
FIG. 2 is a side elevational sectional view of the shoe of FIG. 1.
Figure 3:
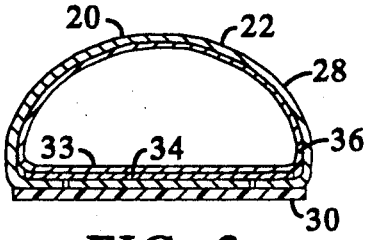
FIG. 3 is a cross-sectional view of the shoe of FIG. 1, taken along the line 3—3 thereof.

Referring to the drawings, FIGS. 1 through 3 show a misses' skimmer, also often referred to as a 'flat' or 'flattie' style, having this style's typical long topline opening and short vamp, and embodying the principles of the present invention.

As best shown in FIGS. 1-3, the shoe 20 of the present invention comprises an upper 22 having a topline 24, topline stitching 26, vamp 28, backpart 32 and unitsole 30.

Upper 22 is lasted over insole 33, cut from a suitable insole material such as Texon, T-480, a man-made cellulose fiber insole material, manufactured by the Texon Materials U.S.A., of Westfield, Mass., and supported by the felt or composition filler element 34. As best shown in FIGS. 2 and 3, lining element 36 is disposed within the shoe cavity defined by upper and unitsole. Lining element 36 is shown at zero tension by the solid lines 36', and under tension as it would be against the forepart of the foot by the broken line 36''. As shown, lining element 36 is attached to the upper by the topline stitching 26 in the midpart and forepart of the topline and to the quarter lining 38 by a stitched seam 44. Quarterlining 38 is in turn attached to upper 22 by topline stitching 26 and to heel tuck 42 by cement lasting thereunder. Preferably, a conventional counter 40 is inserted between upper 22 and quarterlining 38, and cement lasted over insole 33, to provide proper support for backpart 32 and regions adjacent thereto. As best shown in FIG. 3, lining element 36 contacts but is not fastened to upper 22 or insole 33 in the toe of the shoe, and is free to move elastically at least at a right angle to this section of the shoe, i.e. lengthwise along the interior of shoe 20. While the lining element 36 is shown in a tubular configuration as would be afforded by the tubular knit approach used in hosiery manufacture, the use of flat knit or woven spandex materials, cut and seamed to provide the same enclosure and function is an appropriate alternative equivalent. The lining element 36 only partially encloses the foot preferably at about the toes of the foot. It does not extend beyond the upper edge 29 of vamp 28 and over the top of the foot. As a result it is concealed when the shoe is being worn. This is essential since if the lining element were to be exposed the shoe would be aesthetically displeasing and would not be a marketable shoe.

In the embodiment of the invention shown in FIGS. 1–3, the shoe becomes gently and continually urged forward on the foot by the elasticized lining element 36 which maintains a substantially constant pressure on the toes, thereby minimizing or eliminating any space between the heel of the foot and the backpart of the shoe. This minimizes slippage therebetween, with such urging operating most effectively whenever the shoe and foot therein are out of weightbearing contact with the ground. The elastic nature of the lining, however, does allow some motion of the foot in the lengthwise direction when the shoe is in weightbearing contact with the ground.

Lining element 36 is constructed of an elastically lengthwise stretchable material. For example, it may be constructed of a tubular Lycra, knit spandex material similar to stretch socks such as the Gold Toe SuppHose, products made by the Cluett Hosiery Corporation of New York, N.Y., and similar elastically stretchable hosiery products. Lining element 36 may also be made of or include spandex elements of flat knit fabrics similar to those used by the Isotoner Corporation of New York, N.Y., for their stretchable house slippers, in which the same effect is achieved by suitably cutting and stitching the lining parts so they will smoothly and comfortably surround the foot. Alternatively, lining element 36 may also be of woven construction preferably that used in the Spandura, line, produced by H. L. Warshow & Sons, Inc. of New York, N.Y. Transknit, fabrics and Coolmax, fabrics distributed by the Starensier Corp. of Newburyport, Mass. may also be used. In any case, the lining 36 as shown should be made of materials and possibly reinforcements thereof that will allow the lining element to last for the useful life of the shoe.

Alternatively, lining 36 could be a complete sock bottom, as in the Peds, brand of low profile stretch socks made by Peds Products, of Villa Rica, Ga., or the like, which could be removably attached to the shoe by concealed snaps, touch fastener hook/loop tape or other means. In such an embodiment, the fastener would be located inside the shoe just forward of the foremost portion of the topline 24 and/or near the backpart of the shoe. Such lining elements could be easily removed for cleaning, replacement or other reasons.

Figure 4:
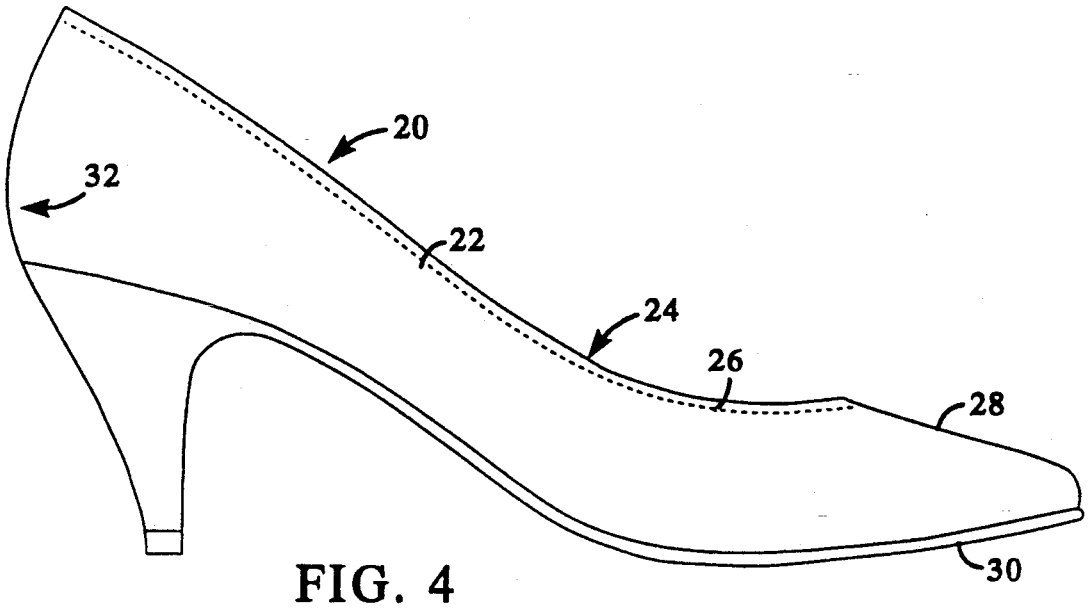
FIG. 4 is a side elevation view of a typical woman's high heeled shoe within which principles of the present invention may be employed.
Figure 5:
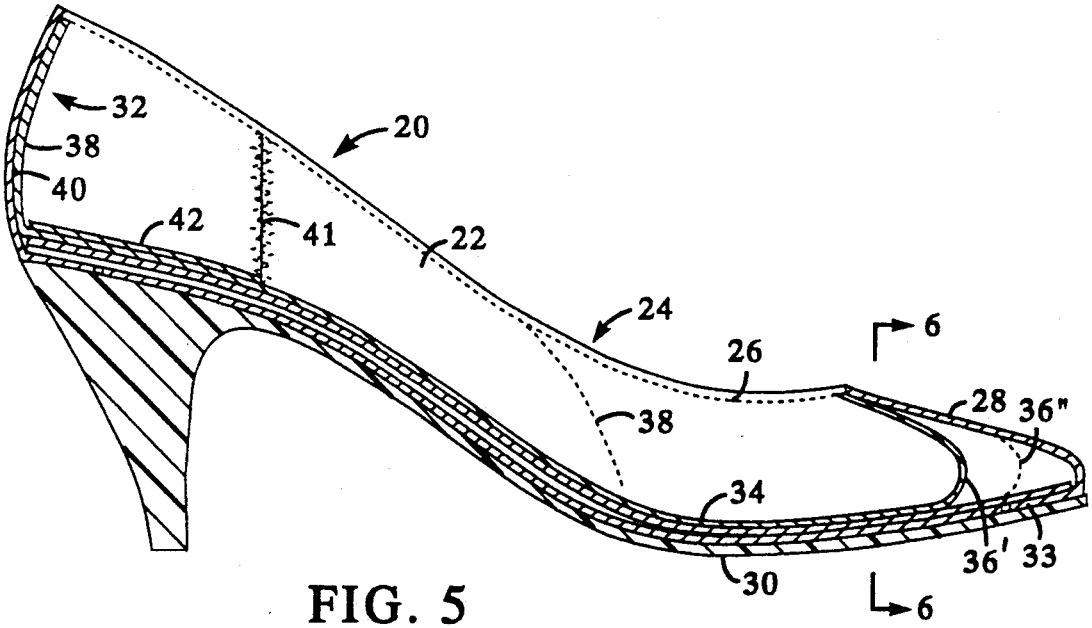
FIG. 5 is a side elevational view of the shoe of FIG. 4.
Figure 6:
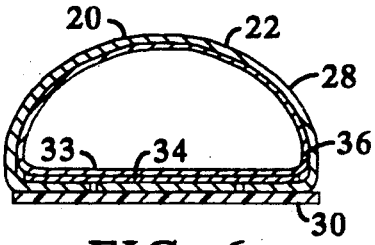
FIG. 6 is a cross-sectional view of the shoe of FIG. 4, taken along the line 3—3 thereof.

FIGS. 4–6 are parallel to FIGS. 1–3 but illustrate the features in a woman's high heeled shoe.

It is, however, presently preferred to use a permanently fastened lining element, since such an element will be appreciably superior in look and function as compared to its removable counterparts.

What is claimed is:

1. A shoe comprising an upper member and a bottom member attached thereto and defining a shoe cavity for receiving a foot, said shoe having a backpart a toe portion and a midpart therebetween, and a means to exert a substantially constant pressure against the toe of the foot to constantly urge the shoe forward relative to a foot disposed within the shoe cavity so as to reduce slippage of the heel of the foot relative to the backpart of said shoe, said urging means comprising an elastic member stretchable in the length-wise direction for only partly enclosing the foot at about the toe portion, aid elastic member being disposed totally within the shoe cavity so as to be concealed within the shoe cavity when a foot is in the shoe, and being unattached to the upper and bottom members at the toe portion of the shoe and attached to the shoe at the midpart of the shoe.

2. The shoe of claim 1, wherein said elastic member is a lining member of the shoe.

3. The shoe of claim 1, wherein the elastic member comprises an elastic sheet material.

4. The shoe of claim 1, wherein elastic member comprises an elastic fabric.

5. The shoe of claim 1, wherein the shoe is a woman's high heel shoe.

6. The shoe of claim 1, wherein the elastic member is permanently attached to the shoe.

* * * * *